US006198054B1

(12) United States Patent
Janniere

(10) Patent No.: US 6,198,054 B1
(45) Date of Patent: Mar. 6, 2001

(54) MULTIPLE ELECTRIC SWITCH WITH SINGLE ACTUATING LEVER

(75) Inventor: Alain Janniere, Paris (FR)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/546,165

(22) Filed: Apr. 11, 2000

Related U.S. Application Data

(63) Continuation-in-part of application No. PCT/FR98/02239, filed on Oct. 19, 1998.

(30) Foreign Application Priority Data

Oct. 20, 1997 (FR) ..... 97 13089

(51) Int. Cl.[7] ..... H01H 9/00; H01H 25/00
(52) U.S. Cl. ..... 200/5 R; 200/6 A
(58) Field of Search ..... 200/5 R, 5 A, 200/6 A, 4, 17 R, 18, 533, 553, 557, 517, 1 B

(56) References Cited

U.S. PATENT DOCUMENTS

| | | | | |
|---|---|---|---|---|
| 4,756,205 | * | 7/1988 | Dickinson | 74/473 R |
| 4,767,901 | * | 8/1988 | Goyarts | 200/306 |
| 5,412,164 | * | 5/1995 | Conway et al. | 200/1 B |
| 5,622,254 | * | 4/1997 | Lee | 200/557 |
| 5,667,061 | * | 9/1997 | Lee | 200/533 |
| 5,952,628 | * | 9/1999 | Sato et al. | 200/4 |

FOREIGN PATENT DOCUMENTS

| | | | |
|---|---|---|---|
| 4409108 | * | 9/1995 | (DE) . |
| 623942 | * | 11/1994 | (EP) . |
| 837964 | * | 6/1960 | (GB) . |
| 2046022 | * | 11/1980 | (GB) . |
| WO 99/21202 | * | 4/1999 | (WO) . |

OTHER PUBLICATIONS

PCT Search Report, WO99/21202 (PCT/FR98/02239), published Apr. 29, 1999, 3 pages.*

* cited by examiner

*Primary Examiner*—J. R. Scott
(74) *Attorney, Agent, or Firm*—Thomas L. Peterson

(57) ABSTRACT

A switch arrangement with multiple switches that can be selectively actuated by operation of a single lever, is of simple construction and occupies a minimum of space on a circuit board. The arrangement includes a housing (100) with a vertical axis (V) and an actuating lever (50) lying along the axis and pivotable about horizontal axes (102, 104). Upper and lower West switches (114, 116) that lie West of the axis, are actuated, one when the lever top is moved West and the other when the lever top is moved East. Similarly, upper and lower South switches (117, 118) are actuated, one when the lever top is moved South and the other when the lever top is moved North. Each pair of switches includes a pair of resilient trip members (32W, 33W and 32S, 33S), and with an arm (68W, 68S) extending horizontally from the middle of the lever and lying between the centers of the trip members. The lever includes a spherical body (48) lying in a spherical recess (46) of the housing to enable the lever to pivot, and a plunger (53) that is vertically slideable in a passage (58) in the spherical body, so when the plunger is depressed it depresses a snap dome trip member (132) to close a fifth switch under the lever. The snap dome biases the plunger upwardly, and the plunger can press upwardly against the spherical body to hold it in the recess.

12 Claims, 4 Drawing Sheets

32S
24S
26S
22S
16
117
35
28S
30C
12
44
35
78S
78W
100
30B
114
28W
24W
26W
46
14
35
32W
22W
30F
V
102
72W
58
48
74W
68W
54
66
50
10
104
52
68S
74S
72S
60
64
U
N
W
E
S
D
33W
117
132
79W
34
128
25W
27W
124
34
23W
29W
122
23S
30A
79S
15
29S
126
30E
33S
30D
118
27S
25S
13

MULTIPLE ELECTRIC SWITCH WITH SINGLE ACTUATING LEVER

CROSS-REFERENCE

This is a continuation-in-part of PCT application PCT/FR98/02239 filed Oct. 19, 1998 which named the United States, which claims priority from French application no. 97 13089 filed Oct. 20, 1997.

BACKGROUND OF THE INVENTION

There is a need for a small multiple switch arrangement that allows selected movement of a single lever, to operate a selected one of many switches. One example is in a mobile telephone, where operation of a lever enables a list of persons that can be called, to be scrolled up by closing a first switch, to be scrolled down by closing a second switch, and with the selected person called by operating a third switch. It is desirable that other functions be switched by manipulating the lever to operate one or more additional switches. Operation of all switches with manipulation of a single lever, avoids the need for a person to move the person's hands between switches. The limited space available on mobile telephones for the switches and operating means, results in the need for a very compact multiple switching arrangement that is operable by using a single lever or other device.

SUMMARY OF THE INVENTION

In accordance with one embodiment of the present invention, a multiple switch arrangement is provided which enables operation of multiple switches by manipulation of a single lever or other actuator, in a construction that is very compact to occupy a minimum area of a circuit board and which is of simple and low cost construction. The switch arrangement includes an actuating lever lying along a primarily vertical axis and pivotable about horizontal axes. The lever has a first arm that extends West from the axis and a second arm that extends South from the axis. A pair of West switches lies West of the axis, including upper and lower West switches lying above and below the first arm. The upper and lower West switches are closed by the first arm when the top of the lever is moved respectively East or West. Similarly, at least one and preferably two South switches lie South of the axis, to be closed when the top of the lever is moved North or South.

Each of the upper switches includes a bowed upper trip member whose middle can be deflected upwardly to close the switch, while each lower switch includes a lower trip member whose middle can be deflected down to close the lower switch. Each arm that extends from the lever, has an arm end that lies between the bowed middle portions of the upper and lower trip members. The end of each arm preferably has upper and lower projections to apply concentrated forces to the middle portions of the trip members to more easily deflect them.

The lever has a spherical body lying in a spherical recess formed in the housing. The body has a vertical passage, and a plunger is slideably mounted in the passage and can be depressed to depress the middle portion of a trip member lying under the plunger.

The housing is preferably formed with upper and lower housing parts that each forms part of a cavity to form cavities between the housing parts. The upper and lower switches lie at the top and bottom of the cavities. An independent switch contact of each upper switch, has a tail that extends to the outside of the housing and down along part of the upper housing part and down along all of the lower housing part and which has a lower end positioned to engage a trace on a circuit board on which the assembly is mounted.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
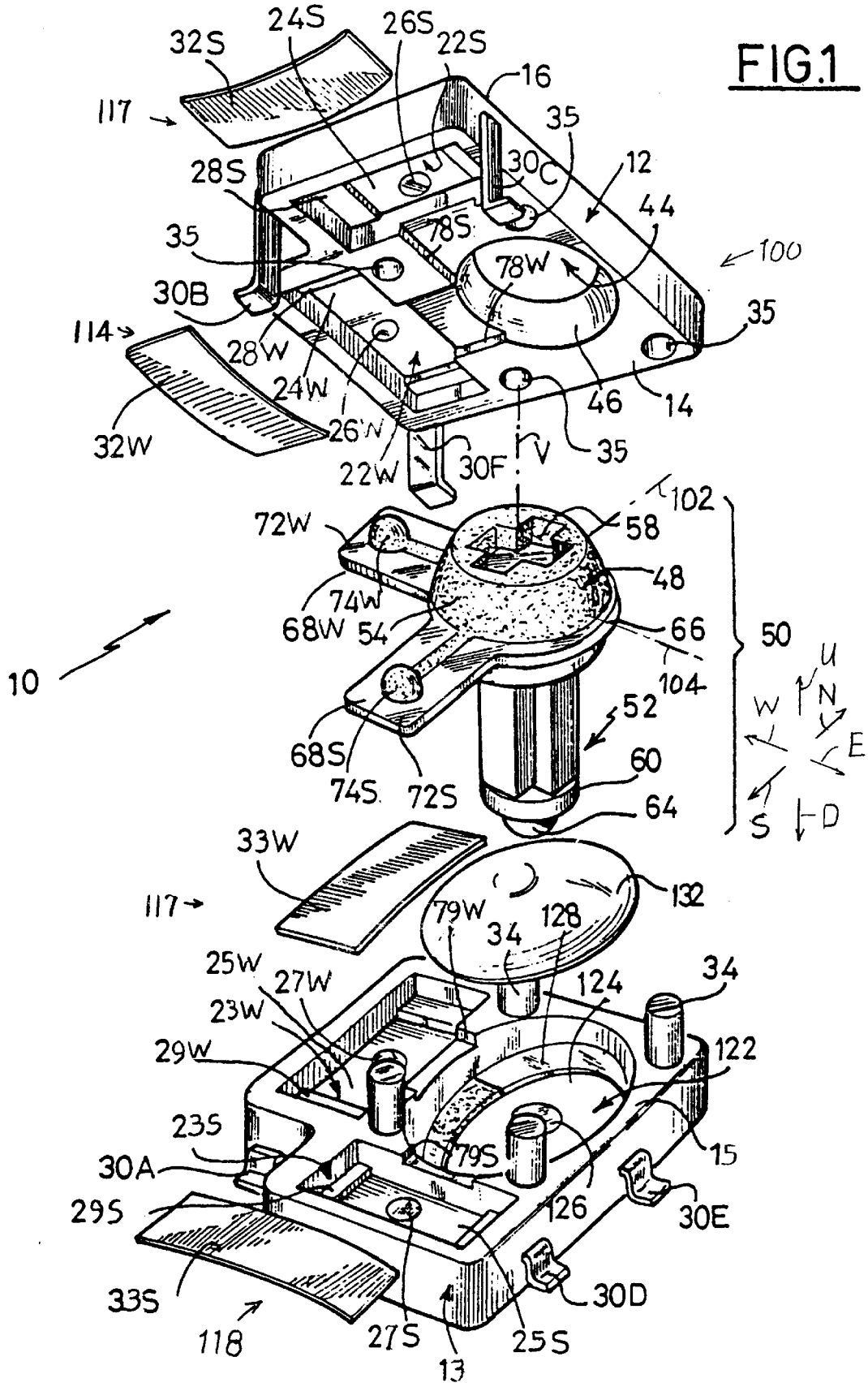
FIG. 1 is an exploded isometric view showing the main components of a multiple electric switch assembly of the present invention.

FIG. 1 illustrates a multiple electrical switch apparatus 10 which includes a housing 100 with upper and lower housing parts 12, 13 that have top and bottom faces 16, 17 and that are joined together at adjacent faces 14, 15. An actuator lever assembly or actuator lever 50 is mounted in the housing along a vertical axis V that extends in upward U and downward D directions at a center region 44. The lever can pivot about a horizontal North-South axis 102 and about a perpendicular horizontal East-West axis 104. The lever has a West arm 68W extending to the West W from the axis V, and has a South arm 68S extending to the South S from the axis. The arms are designed to operate switches when the lever is pivoted.

Figure 5:
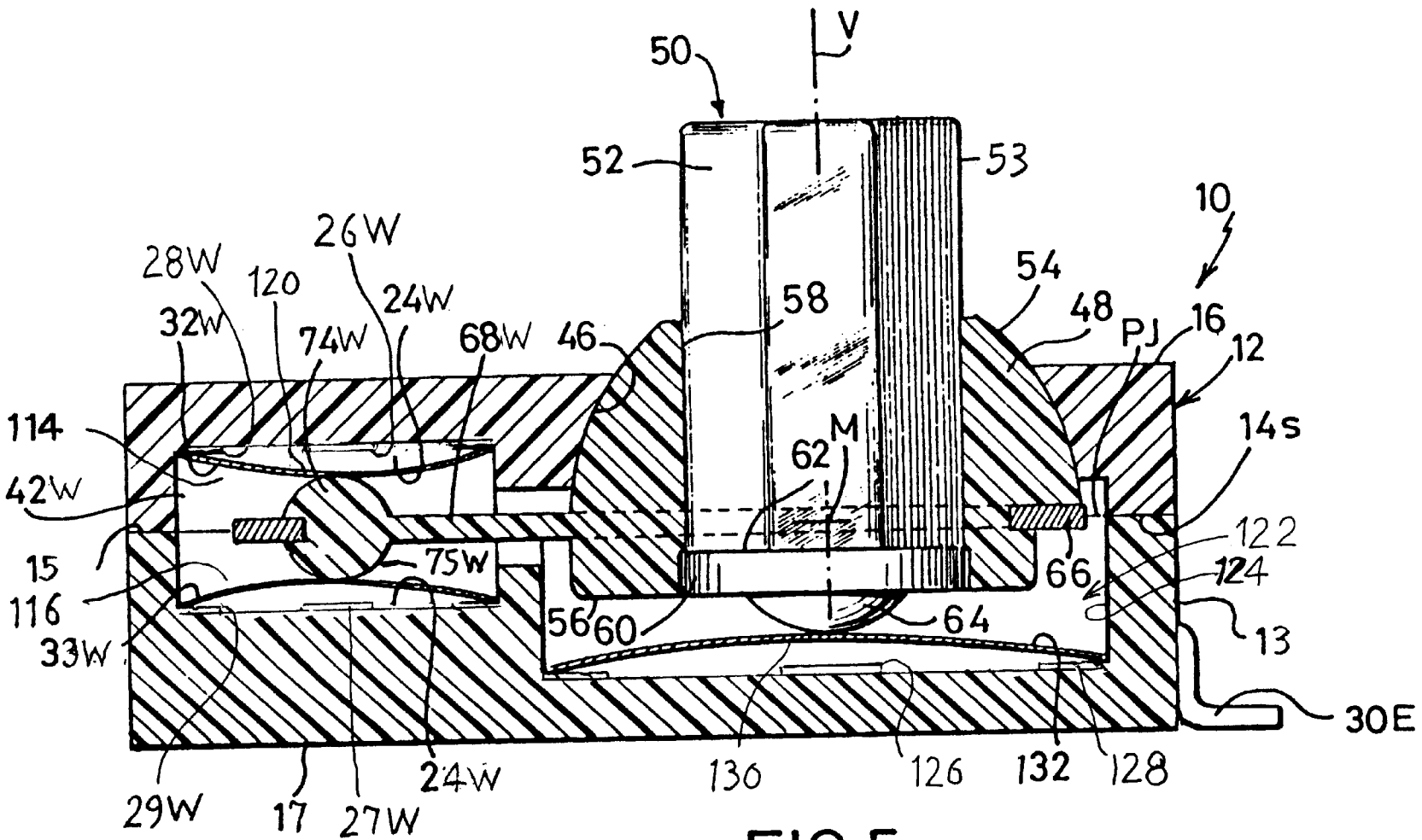
FIG. 5 is an enlarged sectional view, taken on line 5—5 of FIG. 2, with the switch assembly in a rest position wherein all switches are open.

FIG. 5 shows the lever 50 in a rest state, with none of the switches closed. It can be seen that the West arm 68W extends into a side cavity 42W that is horizontally spaced from the vertical axis V of the lever, with the cavity formed by depressions in adjacent faces of the upper and lower housing halves. The cavity holds upper and lower switches 114, 116 that each includes a resilient trip member or trip element 32W, 33W. The upper switch includes an outer contact 28W and a center contact 26W. The trip member 32W has a periphery that engages the outer contact 28W. However, the middle 120 of the trip member is spaced from the center contact 26W. When the top of the lever 50 is moved to the East E, the arm 68W is raised, and a convex deflecting part 74W on the arm pushes up the middle 120 of the trip member to deflect it against the center contact 26W. Since the trip member is of electrically conductive material, this results in closing the upper switch 114 by the trip member engaging both the outer contact 28W and the center contact 26W. The lower switch 116 is of similar construction, with a center contact 27W and outer contact 29W. The arm 68W has a lower convex projection 75W that is positioned to depress the middle of the trip member 33W against a lower center contact 27W to close the lower switch. The lower switch is closed when the top of the lever 50 is moved to the West W. Each of the convex deflecting parts 74W, 75W has a radius of curvature much less than half the length of a trip member 32W, 33W.

Figure 6:
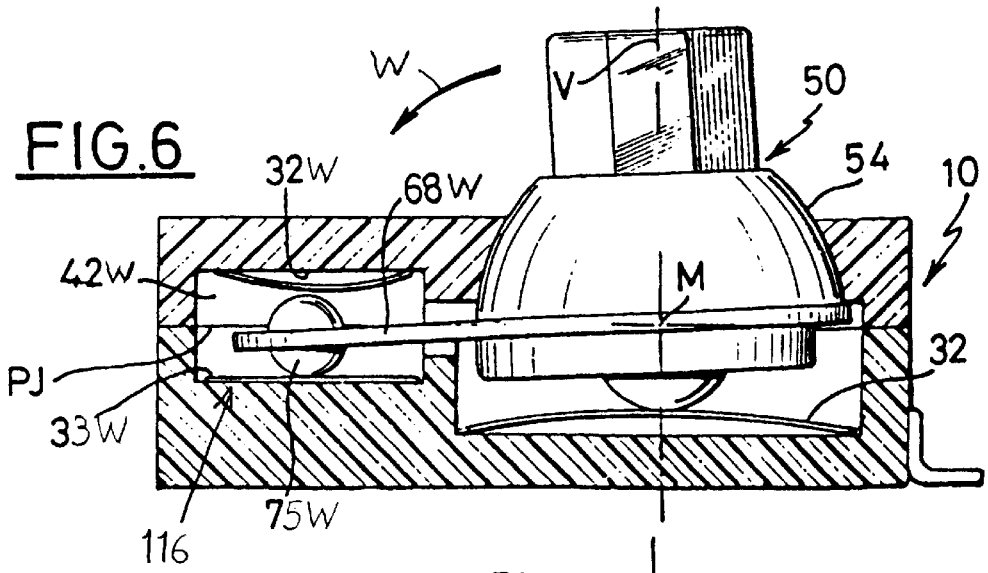
FIG. 6 is a view similar to that of FIG. 5, with the lever top pivoted to the West.
Figure 7:
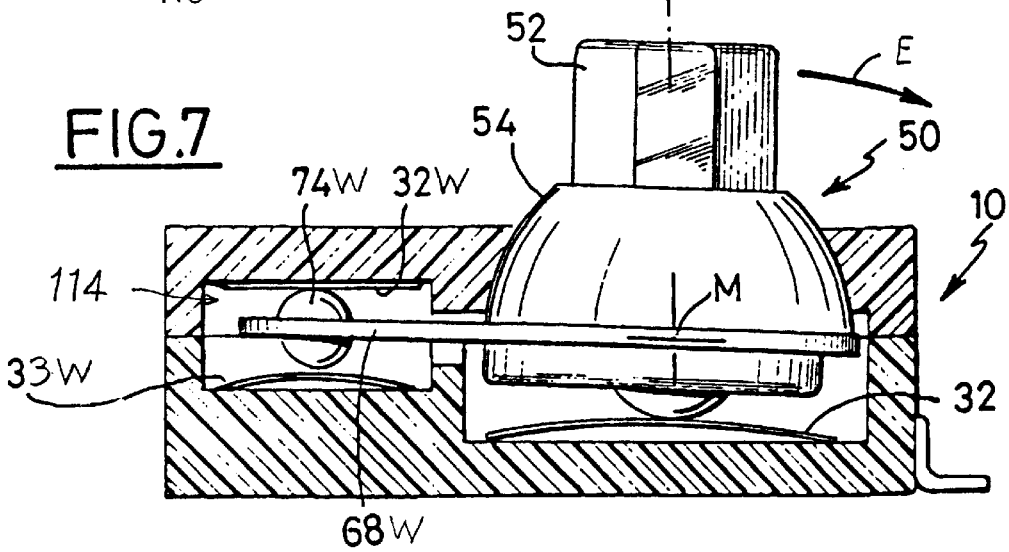
FIG. 7 is a view similar to that of FIG. 6, but with the lever top pivoted to the East.

FIG. 6 shows the switch assembly with the top of the lever 50 moved to the West W, resulting in closing of the lower West switch 116. FIG. 7 shows the top 52 of the lever moved to the East, resulting in closing of the upper West switch 114.

FIG. 1 shows that the switch assembly includes upper and lower South switches 117, 118 that include upper and lower tripping member 32S, 33S, with corresponding center contacts 26S, 27S and outer contacts 28S, 29S. The housing has depressions that form a cavity 22S, 23S in which the center and outer contacts and the tripping members lie, in the same manner as for the West switches shown in FIG. 5.

Figure 8:
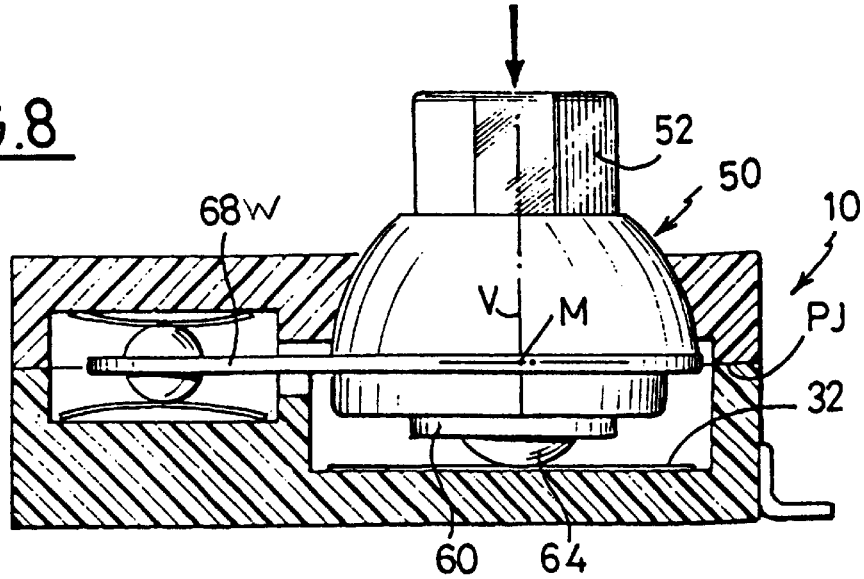
FIG. 8 is a view similar to that of FIG. 5, but with the push button of the lever having been depressed.

FIG. 5 shows that the switch assembly includes a fifth switch or middle switch 122 that lies in a bottom center cavity 124. The middle switch includes a trip member or element 132 lying over an outer contact 128 and a central contact 126. The lever includes a vertical passage 58 and a lever part in the form of a plunger or push button 53 that is slideably mounted in the passage and that forms the top 52 of the lever. When the push button is depressed, a convex projection 64 at the bottom of the push button depresses the middle 130 of the trip element against the center contact 126 to close the middle switch. FIG. 8 shows the push button 50 fully depressed. The rest of the lever, shown in FIG. 5, includes a body 48 and the arms 68W, 68S that do not move down with the push button. The push button has a shoulder 62 that press up the body 48 when the push button is not depressed.

Thus, the switch assembly has five switches which can be selectively operated by a person who manipulates a location on a single element, that being the top 52 of the lever. Different switches are actuated when the top of the lever 52 is moved to the East, to the West, to the North, to the South, or is depressed to move the top of the lever down.

FIG. 5 shows that the body 48 has a spherical surface 54 that extends along part of a sphere and a bottom 56. The housing includes a spherical recess 46 which closely receives the spherical surface of the body in pivoting about the center M of the spherical surfaces. The surface 54 of the body, and preferably the entire body, is of a low friction material to facilitate sliding movement of the body with respect to the recess walls as the lever pivots. Such pivoting is limited to pivoting about the North-South axis and the East-West axis. The body is constructed with a metal plate 66 that extends around the vertical cruciform passage 58 in the body and that has arm cores extending along the arms 68W, 68S to stiffen them, with plastic overmold around each arm.

FIG. 1 shows that the lower and upper housing parts have slot parts 78W, 79W that form a horizontal arm passage through which the West arm 68W extends. The side walls of the slot formed by the slot parts keep the West arm 68W centered in the West cavity 42W. Similarly, South slot parts 78S, 79S form another arm passage that positions the South arm 68S. The side walls of the arm passages limit pivoting of the lever about the vertical axis V.

The upper and lower housing parts 12, 13 are formed of molded plastic, with the lower part having upstanding pegs 34 that fit into corresponding holes 35 in the upper housing part. After the pegs project through the holes, the upper ends of the pegs can be heat deformed to lock the housing parts together.

Figure 4:
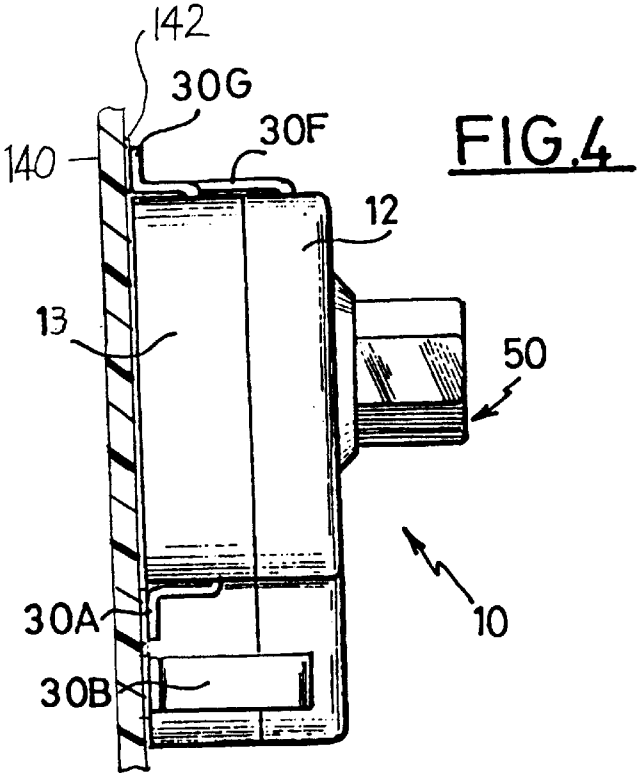
FIG. 4 is a front elevation view of the switch assembly of FIG. 2, shown mounted on a circuit board.
Figure 3:
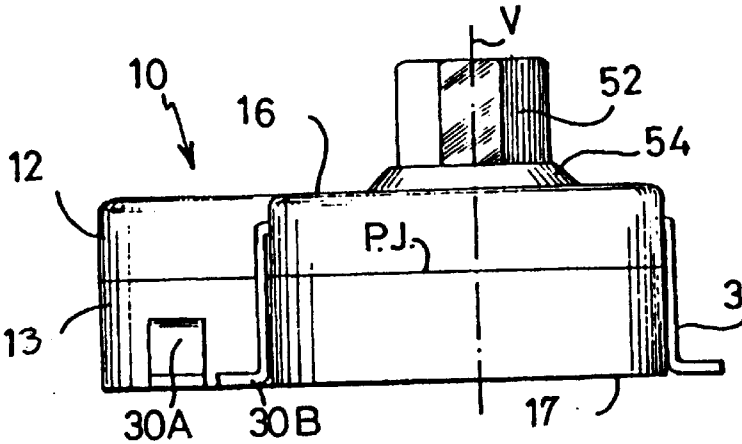
FIG. 3 is a side elevation view of the switch assembly of FIG. 2.

Applicant prefers to connect all lower outer contacts, such as 29W, 29S and 128 together and to a single tail 30A. Each lower center contact 27W, 27S and 126 is an independent contact, connected to separate tail 30B, 30D and 30E. All tails lie outside the housing for soldering to conductive traces on a circuit board. Each contact has a portion that is molded in the corresponding housing half. Upper tails 30B, 30C, and 30F extending from contacts mounted on the upper housing part 12, are vertically elongated, and extend down along the outside of the lower housing part 13 so the upper tails can be soldered to traces on a circuit board. FIG. 4 shows the switch assembly 10 lying on a circuit board 140, with the bottom of the tails soldered to traces 142 on an upper face of the circuit board on which the switch assembly lies. Of course, the tails can have pins at their lower ends which extend through plated holes in the circuit board.

Figure 2:
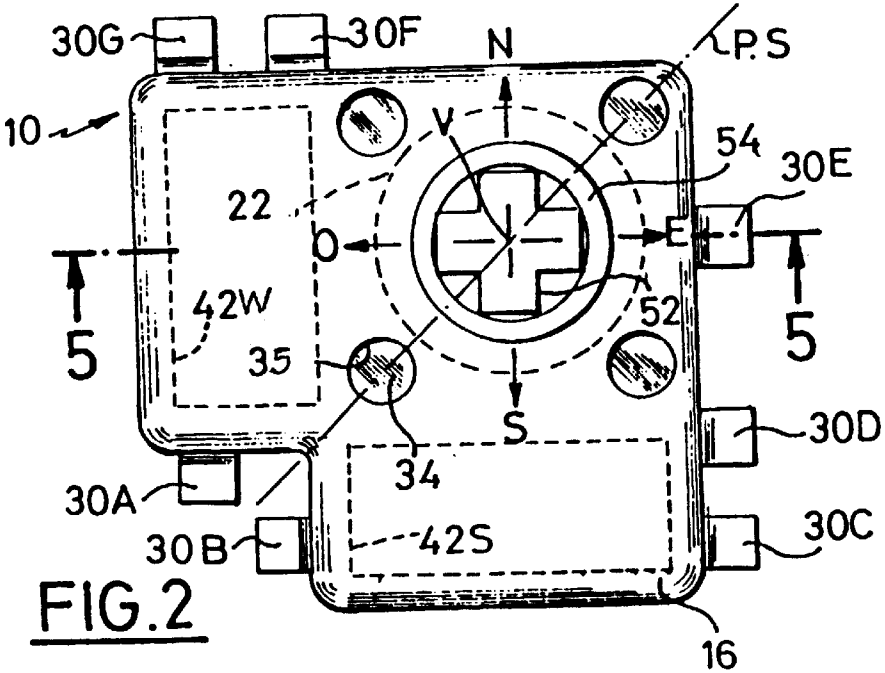
FIG. 2 is a plan view of the assembled switch assembly of FIG. 1.

FIG. 2 shows that the switch assembly 10 has a plane of symmetry PS, with portions on opposite sides of the plane of symmetry being mirror images of each other. The vertical axis V along which the lever 50 lies, lies on the plane of symmetry, with pairs of switches lying East and South of the axis V. It is possible to provide a switch of mirror image from that of FIG. 2, with switches lying East and South of the axis V. A description of switches lying West and South of the axis V, includes the case where the switch assembly is upside-down so the switches would appear to extend East and South of the axis V.

FIG. 1 shows that the trip member 132 that lies under the push button of the lever, is in the form of an upwardly bowed dome. When the push button 52 is partially depressed, the dome snaps down, to not only close the switch but to provide a tactile feedback. The four trip members of the four other switches can be made dome shaped to also snap when deflected, to provide tactile feedback, although feedback can be provided on a screen, by the changing of an image corresponding to the particular switch that is operated.

Applicant's switch is compact, and occupies a minimum space on the circuit board. This is because there are only West and South extensions of the middle of the switch assembly, to accommodate the two West and two South switches. Additional extensions are not required to the East or to the North. This is important in applications such as on a mobile phone, where there is little space available on the circuit board for the multiple switch arrangement. This arrangement also minimizes the size of the switch.

While terms such as "upper", "lower", etc. have been used to help describe the invention as illustrated, it should be understood that the switch and its parts can be used in any orientation with respect to the Earth. Also, while the directions "East, West, North and South" are shown to help describe the invention, as illustrated, different relative directions can be used. For example, a mirror image switch assembly can be constructed, with switches lying South and East of the vertical axis, or with the switch assembly turned about the vertical axis.

Thus, the invention provides a multiple switch arrangement that allows each of a plurality of switches to be actuated (closed or opened) by manipulation of a single lever, where the arrangement is compact and of easily manufactured design, with a minimum number of parts and with the parts easily held in place. The arrangement includes an actuating lever lying in a housing along a vertical axis, and pivotable about a horizontal East-West axis and about a perpendicular horizontal North-South axis. A pair of upper and lower switches are spaced from the vertical axis along the East-West axis, and another pair of upper and lower switches are spaced from the vertical axis along the North-South axis. This permits closing of a selected one of the four switches by pivoting the lever so its upper end moves in a selected one of the four directions East, West, North, South. The lever includes a body with a part spherical surface that can pivot within a part spherical recess in the housing. The lever also includes a plunger or push button, that can be depressed to operate a fifth switch. The construction of the assembly with housing projections and switches spaced from the housing center in each of two perpendicular directions, such as Eastward and Southward, but not in the other two perpendicular directions (Northward or Westward) results in a compact switch arrangement that occupies a minimum of space on a circuit board.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A multiple switch arrangement comprising:

a housing;

an actuating lever having a lever top, with said lever lying in said housing at a primarily vertical axis and pivotable about a horizontal North-South axis and about a perpendicular horizontal East-West axis, said lever having a West arm and a South arm extending, respectively, primarily West and primarily South from said vertical axis;

a pair of West switches lying primarily West of said axis, including a lower West switch that is actuated when said lever top is moved West to lower to said West arm, and an upper West switch that is actuated when said lever top is moved East to raise said West arm;

at least one South switch lying primarily South of said axis, and that is actuated by said South arm when said lever top is moved in a predetermined direction that is largely parallel to said North-South axis.

2. The switch arrangement described in claim 1 wherein:

said lever includes a lever body that is pivotally mounted on said housing to pivot about said North-South axis and about East-West axis, with said body having a vertical passage with a lower end;

said lever includes a plunger that is slideably mounted in said vertical passage;

a switch lying at said lower end of said passage, to be operated by depression of said plunger.

3. The switch arrangement described in claim 1 wherein:

said pair of West switches includes upper and lower resilient trip members lying one below the other, with each trip member having a middle portion and a peripheral portion, said lower switch includes a pair of lower switch contacts lying below the corresponding lower trip member and said upper switch includes a pair of upper switch contacts lying above the corresponding upper trip member, with each trip member including a middle portion and opposite sides and with each pair of switch contacts including a middle contact lying opposite and normally spaced from the middle portion of the corresponding trip member and a side contact lying against the peripheral portion of the trip member;

said lever includes a pair of arms that each has an outer end with a pair of convex projections lying respectively against the middle of one of said upper trip members and against the middle of one of said lower trip members.

4. The switch arrangement in claim 1 wherein:

said housing has North, South, East, and West walls, with the distance between said axis and said North wall being less than the distance between said axis and said South wall, and with the distance between said axis and said East wall being less than the distance between said axis and said West wall.

5. A multiple switch arrangement, comprising:

a housing which includes a vertical axis and a plurality of horizontally-spaced cavities lying along different horizontal directions that are angularly spaced about said axis;

a plurality of switches lying in said cavities, including in each cavity an upper switch that includes an upper resilient trip member with an upper member middle and that also includes an upper center contact lying above said upper trip member middle and a second contact engaged with said upper trip member, and including in each cavity a lower switch that includes a lower resilient trip member with a lower member middle portion and that also includes a lower center contact lying below said lower trip member middle portion and a second contact engaged with said lower trip member;

an actuating lever having a center lying substantially on said axis and being pivotable on said housing about a plurality of horizontal axes, said lever having a plurality of arms each projecting into one of said cavities and having an end positioned to upwardly deflect one of said upper trip members and downwardly deflect one of said lower tripping members when said lever is pivoted to respectively raise and lower the corresponding arm.

6. The switch arrangement described in claim 5 wherein:

said housing includes a recess that holds said center of said lever, and said housing includes upper and lower housing parts that each forms about half of each of said cavities and that each forms a plurality of horizontal arm passages connecting said central cavity region to each of said cavities, with each of said arms extending through one of said arm passages and with each arm passage limiting pivoting of said lever about said vertical axis to locate the arm about said vertical axis.

7. The switch arrangement described in claim 5 wherein:

said plurality of cavities consists of only two cavities, including a South cavity and a West cavity lying respectively South and West of said axis.

8. The switch arrangement described in claim 5 wherein:

said lever includes a metal plate that lies in a primarily horizontal plane and that forms a plurality of arm cores that extends along each arm into each of said cavities, and said lever includes a polymer overmold on each of said arms, with each overmold forming a pair of convex projections that lie respectively against the upper trip member middle and the lower trip member middle.

9. A multiple switch arrangement, comprising:

a housing that has a vertical axis and that includes polymer molded upper and lower housing halves that fit together to form said housing, with said housing halves forming a first side cavity between them that is spaced from said axis, with said upper housing part having spherical walls forming a part spherical recess that faces primarily downwardly along said vertical axis, and with said lower housing part forming a bottom recess under said part spherical recess;

a pair of first contacts lying in said bottom recess, and a resilient center trip member that is upwardly bowed and that has an edge that engages one of said first contacts and that has a middle portion lying over the other first contact to engage it when said trip member middle is depressed;

a switch lying in said first side cavity;

a lever having a partially spherical body lying in said spherical recess, with said lever having a lever part with a lower end that lies against said resilient center trip member to downwardly deflect said center trip member when said lever part is depressed, said body having a primarily horizontally-extending arm extending into said first side cavity to operate said switch when said body is pivoted.

10. The switch assembly described in claim 9 wherein:

said partially spherical body has a vertical passage, and said lever part comprises a push button that is vertically slideable in said passage and that forms a lower end that lies against said resilient trip member, with said push button having an upwardly-facing shoulder that abuts said body to push it into said spherical recess when said push button is not depressed.

11. A multiple switch arrangement, comprising:

a housing that includes upper and lower housing halves that have outside walls and that fit together to form a housing that has a vertical axis, with each of said housing halves being a molded polymer part, and with said housing halves forming first and second side cavities between them that are each spaced from said axis, and said housing forming a center cavity lying along said axis;

a pair of first switches lying in said first cavity including upper and lower first switches, and at least one second switch lying in said second cavity with each of said switches having an independent switch contact;

an actuator moveably mounted in said housing and coupled to said switches to selectively operate them;

a circuit board which has an upper face with a plurality of traces thereon;

the independent switch contact of said upper switch includes a vertically elongated contact tail that extends from said upper housing half and down along an outer wall of said lower housing half to one of said traces.

12. The switch arrangement described in claim 11 wherein:

each of said switches includes a trip member, with said lower switch including an upwardly bowed lower trip member, and with said upper switch including a downwardly bowed upper trip member;

said actuator is in the form of a lever that is pivotable about a plurality of horizontal axes on said housing, and said actuator has a plurality of arms that each extends into one of said side cavities including a first arm that lies between the upper and lower trip members in said first cavity.

* * * * *